United States Patent [19]

Franz

[11] Patent Number: 5,002,180

[45] Date of Patent: Mar. 26, 1991

[54] ROSIN HOLDER AND GUIDE FOR MUSICAL INSTRUMENT

[76] Inventor: Beth L. Franz, 44 Clarence Terrace, Regents Park, London, England, MW 14RD

[21] Appl. No.: 559,322

[22] Filed: Jul. 30, 1990

[51] Int. Cl.[5] ..... B65D 85/00

[52] U.S. Cl. ..... 206/14; 84/329; 84/453; 401/88

[58] Field of Search ..... 84/329, 453; 206/14, 206/314, 447, 527, 591, 592; 401/88

[56] References Cited

U.S. PATENT DOCUMENTS

| | | | |
|---|---|---|---|
| 331,751 | 12/1885 | Angus | 84/329 |
| 509,482 | 11/1893 | Müller | 84/329 |
| 530,946 | 12/1894 | Heskett | 84/329 |
| 1,098,277 | 5/1914 | Lohmann | 84/329 |
| 1,137,414 | 4/1915 | Mollenhauer et al. | 84/329 |
| 1,323,612 | 12/1919 | Rich | 401/88 |
| 2,431,861 | 1/1948 | Pachner | 401/88 |
| 4,515,272 | 5/1985 | Newhouse | 206/592 |

FOREIGN PATENT DOCUMENTS

| | | | |
|---|---|---|---|
| 0174793 | 6/1941 | Austria | 84/329 |
| 0062676 | 7/1892 | Fed. Rep. of Germany | 84/329 |
| 0079349 | 11/1918 | Switzerland | 401/88 |
| 0143232 | 11/1920 | United Kingdom | 401/88 |

*Primary Examiner*—Jimmy G. Foster

*Attorney, Agent, or Firm*—Graybeal, Jensen & Puntigam

[57] ABSTRACT

A guide to assist a player of a stringed instrument in the process of applying rosin to their bow including a base (2) and a pair of parallel guides (8, 10) which are parallel to the diameter of the rosin and are capable of rotating about the axis of the rosin.

6 Claims, 3 Drawing Sheets

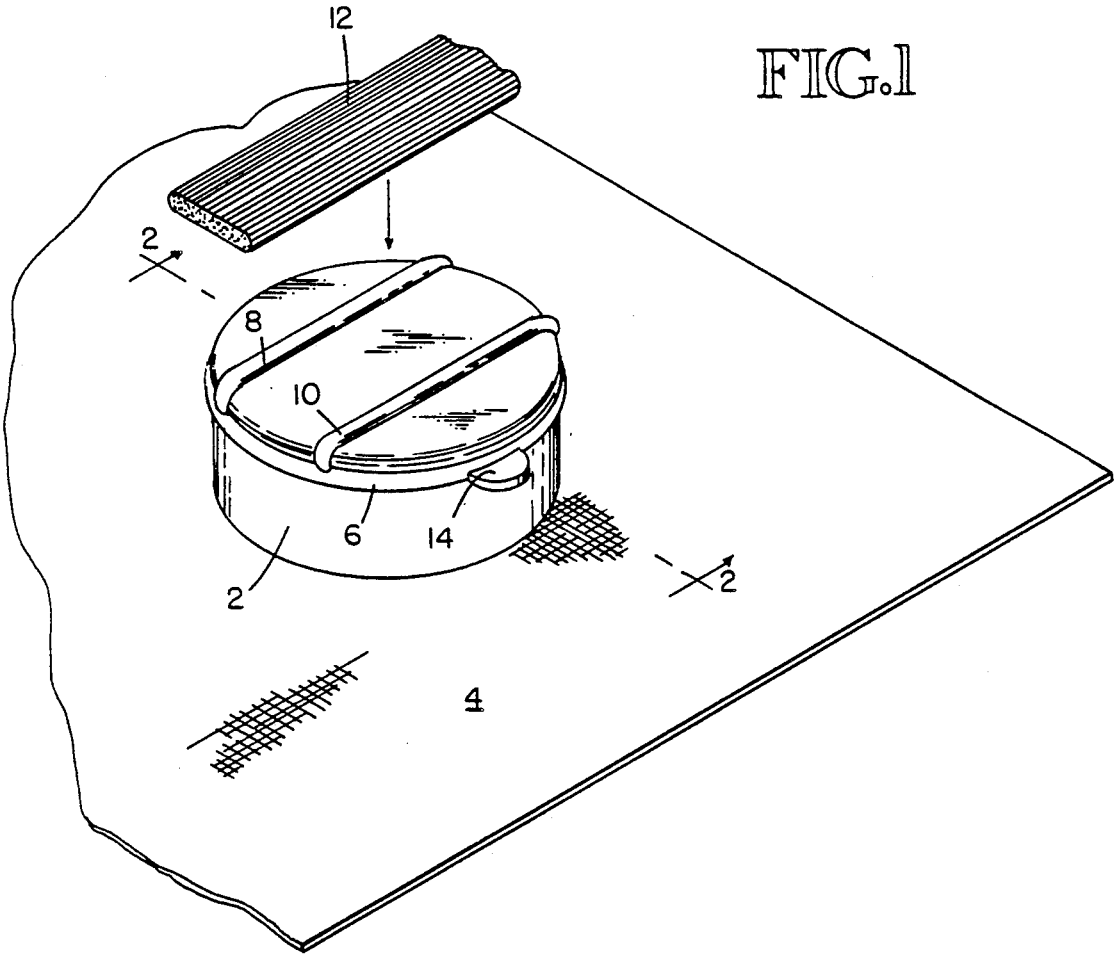
FIG.1
FIG.2
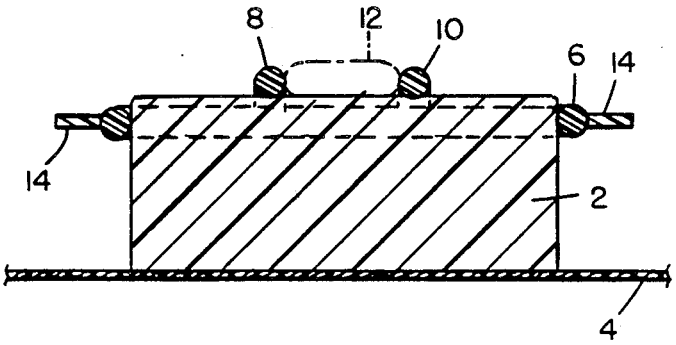

FIG. 7
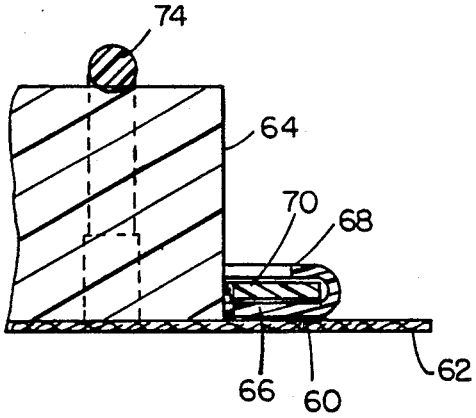
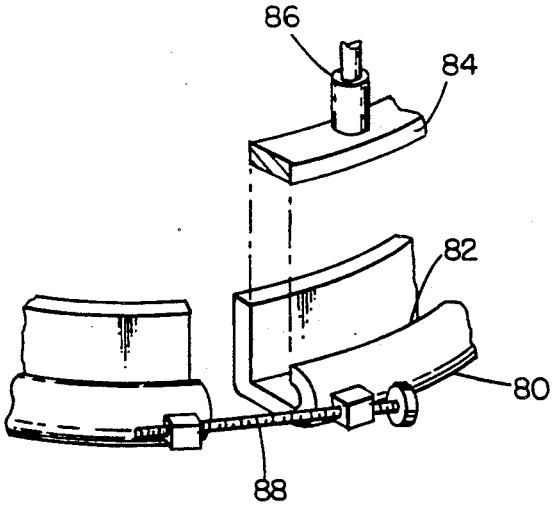
FIG. 8

ROSIN HOLDER AND GUIDE FOR MUSICAL INSTRUMENT

TECHNICAL FIELD

This invention relates to a guide for use in conjunction with applying rosin to the bow of a musical instrument and more particularly, to a guide which overlies a piece or cake of rosin, guiding the bow so that it will not inadvertently slip off the rosin and permits relative rotation of the guide so that the rosin is used uniformly.

BACKGROUND ART

Players of stringed instruments such as violins, violas and the like use rosin on the bows of their instruments to cause greater contact with the strings and also to improve the quality of the resulting sound. Since a high quality rosin is relatively expensive, it is imperative that it be utilized to its maximum and this is done by stroking the bow over the rosin at different angles to wear the rosin evenly.

New rosin cakes have a slippery or frictionless surface that wears away only with use. "Starting" a rosin can prove exasperating even for professional players. For the student or amateur, the frustration of "wearing in" rosin often leads to insufficient application. This in turn, creates poor sound, poor results and slippage which inhibits the technical mastery of the bow, and can dampen concentration and enthusiasm.

Devices known to the present inventor for containing a rosin cake include U.S. Pat. No. 243,763, granted on July 5, 1881, which discloses a rosin holder attached to the clip which is in turn attached to the violin.

U.S. Pat. No. 1,098,277, granted May 26, 1914, discloses a rosin cake in a box and includes alternating sections of hard and soft rosin.

U.S. Pat. No. 4,515,272, granted to Newhouse on May 7, 1985 discloses a rectangular shock absorbing holder for a rectangular bar of rosin.

Swiss Pat. 108951, granted in 1925, discloses a container to capture the dust from the use of rosin.

DISCLOSURE OF THE INVENTION

It is an object of the present invention to provide a device for use in conjunction with a cake of rosin such that the individual who is applying rosin to the bow of his instrument is assisted by guides which extend over the face of the rosin but which also permit the bow to be passed over the rosin along more than one diameter assuring that the rosin will be uniformly worn.

It is another object of the present invention to provide a device which is of a configuration for supporting a cake of rosin while simultaneously allowing a guide to be selectively placed along the surface of the rosin assuring that the rosin will be uniformly worn.

It is still another object of the present invention to provide a device which may be utilized in conjunction with a commercial cake of rosin such that the guide device may be placed in a position surrounding the rosin, secured to the cloth which is traditionally attached to the base of the rosin cake which assists the player in stroking the rosin along different diameters.

Yet another object of the present invention is to provide a guide device for use in conjunction with a cake of rosin wherein the guide is clamped to the rosin cake.

BRIEF DESCRIPTION OF THE DRAWINGS

FIG. 1 is an isometric view of a cake of rosin having one embodiment of the present invention frictionally secured to the upper portion thereof.

FIG. 2 is a vertical section taken along line 2—2 of FIG. 1.

FIG. 7 is yet another embodiment wherein the guide device is adhesively secured to a rosin supporting cloth.

FIG. 8 is still another guide device wherein the device is clampingly secured to the rosin cake.

BEST MODE FOR CARRYING OUT THE INVENTION

Figure 3:
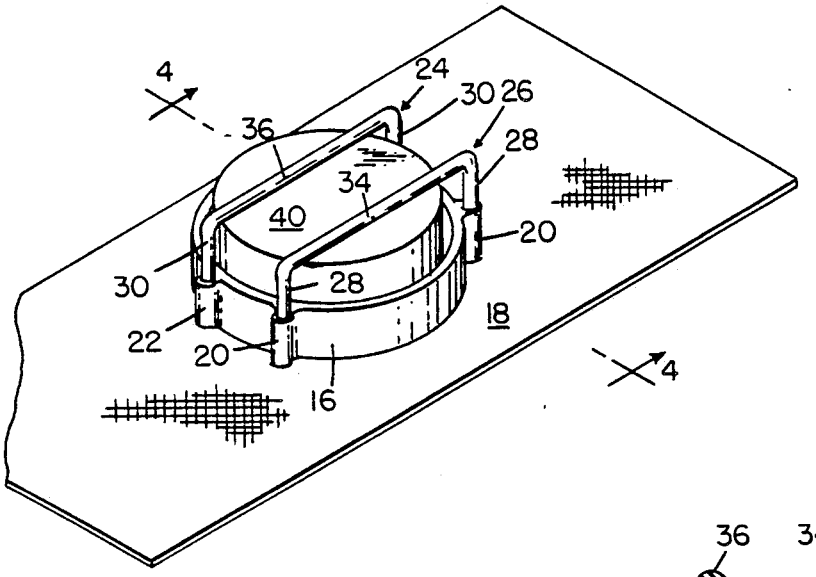
FIG. 3 is a second embodiment of the present invention wherein the cake of rosin is secured to a disc permitting the rosin to rotate relative to a pair of rosin-spanning guide means.

As seen in FIG. 1, a cylindrical cake of rosin 2 is secured to a fabric material 4 which is then used to wrap the cake when not in use and has frictionally secured thereto a ring 6 having a pair of parallel bridging members 8 and 10 for guiding the strings of a bow 12 over the face of the rosin cake 2. A pair of ear-like devices 14 are provided for placing the guide in position over the cake and likewise for rotating the guide relative to the cake such that the rosin cake may be uniformly worn. It is to be understood that the guide device comprising parts 6, 8, 10, 14 would preferably be made of an inert material being slightly elastomeric such that it would be frictionally held in position but also would be adaptable to rosin cakes that varied slightly in diameter.

Figure 4:
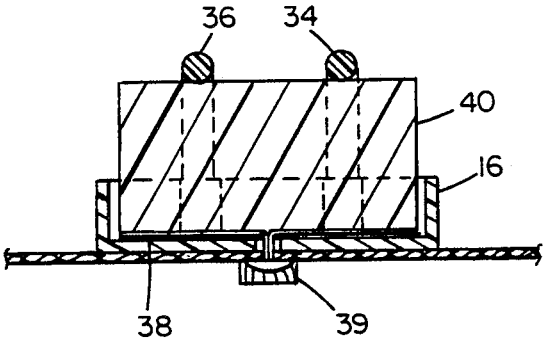
FIG. 4 is a vertical section taken along line 4—4 of FIG. 3.

As seen in FIGS. 3 and 4 a second embodiment includes an upwardly open dish member 16 which is secured to fabric 18 and includes two pair of upwardly open female socket members 20, 22 telescopically receiving guide members 24, 26 which include downwardly extending legs 28, 30 connected by base members 34, 36 such that the guide may be moved toward the cloth during use as the cake of rosin is reduced in length.

As seen in FIG. 4 the upwardly open dish member 16 has rotatably secured therein a disc member 38 to which the rosin cake 40 is secured for rotation relative to the rigid members 34, 36. A handle 39 is provided to assist in the relative rotation.

Figure 5:
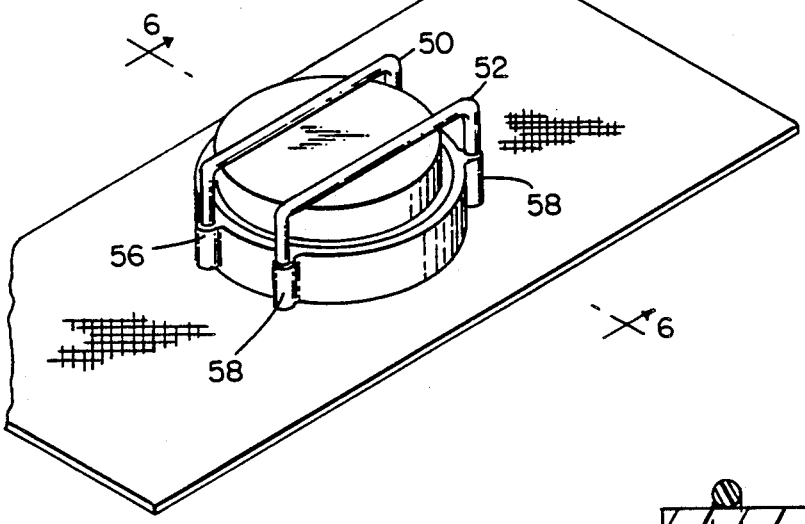
FIGS. 5 and 6 depict a third embodiment of the present invention wherein the rosin is secured in a cup-like device.
Figure 6:
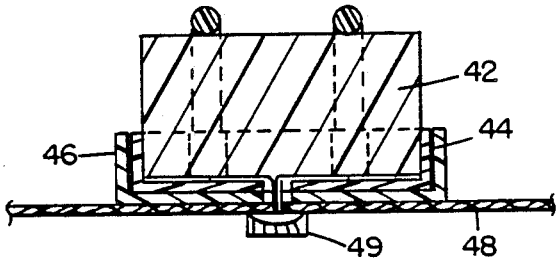

The embodiment shown in FIGS. 5 and 6 is similar to the embodiment of FIGS. 3 and 4 with the exception that the rosin cake 42 is molded into an interior upwardly open dish member 44 which is rotationally secured to outer dish member 46 which is in turn secured to the cloth 48. Again as seen in this view the guide function is performed by a pair of inverted wide U-shaped bridging members 50, 52 which are respectively received in telescopic fashion into upwardly open sockets 56, 58. A handle 49 causes 44 to rotate relative to 46.

FIG. 7 depicts an embodiment using an adhesive, as shown in this view, as a two-sided tape type adhesive, for securing a guide to a premanufactured rosin cake secured to a cloth. The two-side adhesive tape 60 is secured to the cloth 62 surrounding the rosin cake 64 and has secured thereto a disc 66 which has an inwardly turned circumferential lip 68 which captures a flat ring element 70 to which is secured upwardly extending bridge member 74 for providing guidance to the bow during the application of the rosin. The embodiment of FIG. 8 utilizes a split ring 80 which is in the shape of a J in cross section including an inwardly projecting lip 82 for capturing a flat disc 84 to which the guides 86 are secured, as hereinbefore described, permitting relative rotation. Split ring 80 adapts to various diameter rosin cakes by adjusting screw means 88 which is threadingly secured to split ring 80, bridging the gap and allowing the gap to be widened or narrowed.

Thus as can be seen the present invention, although simple in construction, provides a useful and necessary by providing guidance to the individual who is placing on his bow, preventing inadvertent sideward movement and assuring that the rosin will be uniformly worn.

I claim:

1. A guide to assist in controlling the wear on a piece of rosin by limiting the lateral movement of the bow during the process comprising;

a base member to encircle the rosin when in place, and a pair of substantially parallel bridge elements, said bridge elements extending upwardly from the base member and across the rosin on opposite sides of a diameter of the base, said bridge elements rotatable relative to the rosin enabling an even wearing of the rosin.

2. A guide as in claim 1 wherein the base member is frictionally secured to the rosin.

3. A guide as in claim 1 wherein a plate is rotationally mounted within the base member and supports the rosin.

4. A guide as in claim 1 wherein the bridge members are variable in height.

5. A guide as in claim 1 wherein the base is rotationally captured within a guide which includes an adhesive on its lower surface for attachment to the rosin support.

6. A guide as in claim 1 wherein the base member is capable of having its diameter adjusted mechanically.

* * * * *